US009119471B2

(12) United States Patent
Gonzalez et al.

(10) Patent No.: US 9,119,471 B2
(45) Date of Patent: Sep. 1, 2015

(54) SUPPORT BRACKET

(71) Applicant: SPG International LLC, Covington, GA (US)

(72) Inventors: Arturo Gonzalez, Lilburn, GA (US); Steven M. Kessell, Loganville, GA (US); Michael D. Potter, Marydel, DE (US)

(73) Assignee: SPG International LLC, Covington, GA (US)

( * ) Notice: Subject to any disclaimer, the term of this patent is extended or adjusted under 35 U.S.C. 154(b) by 0 days.

(21) Appl. No.: 13/830,962

(22) Filed: Mar. 14, 2013

(65) Prior Publication Data

US 2014/0263125 A1 Sep. 18, 2014

(51) Int. Cl.

| | |
|---|---|
| ***A47F 5/00*** | (2006.01) |
| ***A47F 5/08*** | (2006.01) |
| ***A47B 96/06*** | (2006.01) |
| ***A47B 96/14*** | (2006.01) |

(52) U.S. Cl.

CPC ..... *A47B 96/061* (2013.01); *A47B 96/1408* (2013.01)

(58) Field of Classification Search

CPC ..... A47B 57/06; A47B 57/42; A47B 96/061; A47B 96/028; A47B 57/45

USPC ..... 211/187, 186, 192, 193, 150, 134, 175, 211/90.02, 90.04, 90.01; 248/220.31, 248/220.41, 220.42, 220.43, 243, 250, 235, 248/239, 241, 249, 220.21, 245, 247, 248/225.21; 108/106, 107, 147.17

See application file for complete search history.

(56) References Cited

U.S. PATENT DOCUMENTS

| | | | | | |
|---|---|---|---|---|---|
| 1,702,937 | A | * | 2/1929 | Friedemann | 248/243 |
| 2,008,180 | A | * | 7/1935 | Karnes | 211/193 |
| 2,246,090 | A | * | 6/1941 | Filer | 5/296 |
| 2,263,282 | A | * | 11/1941 | Welch et al. | 248/243 |
| 2,919,034 | A | * | 12/1959 | Levy | 108/1 |
| 2,940,601 | A | * | 6/1960 | Smith | 108/152 |
| 2,971,805 | A | * | 2/1961 | Weiss | 312/108 |
| 3,057,483 | A | * | 10/1962 | Derman | 211/193 |
| 3,194,528 | A | * | 7/1965 | Chesley | 248/250 |

(Continued)

FOREIGN PATENT DOCUMENTS

| | | |
|---|---|---|
| DE | 1138902 | 10/1962 |
| DE | 9109395 | 9/1991 |

(Continued)

OTHER PUBLICATIONS

International Search Report and Written Opinion received in International Patent Application No. PCT/US2014/026525 dated Jul. 28, 2014 (11 pages).

*Primary Examiner* — Daniel J Troy
*Assistant Examiner* — Kimberley S Wright
(74) *Attorney, Agent, or Firm* — Michael Best & Friedrich LLP

(57) ABSTRACT

A shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

18 Claims, 6 Drawing Sheets

(56) References Cited

U.S. PATENT DOCUMENTS

| | | | | | |
|---|---|---|---|---|---|
| 3,229,823 | A | * | 1/1966 | Hummer | 211/187 |
| 3,273,847 | A | | 9/1966 | Berman | |
| 3,294,351 | A | * | 12/1966 | Rollins, Jr. | 248/243 |
| 3,353,684 | A | * | 11/1967 | Chesley | 211/187 |
| 3,355,134 | A | * | 11/1967 | Chesley | 248/250 |
| 3,358,956 | A | | 12/1967 | Thornton | |
| 3,450,270 | A | * | 6/1969 | Brown | 211/193 |
| 3,479,975 | A | | 11/1969 | Ferdinand et al. | |
| 3,495,718 | A | * | 2/1970 | Romero | 211/88.01 |
| 3,565,381 | A | * | 2/1971 | Oliver | 248/243 |
| 3,572,626 | A | | 3/1971 | Bertschi | |
| 3,627,247 | A | * | 12/1971 | Krikorian | 248/243 |
| 3,740,776 | A | * | 6/1973 | Lazarus | 5/296 |
| 3,784,025 | A | * | 1/1974 | Dumit | 211/189 |
| 3,793,655 | A | * | 2/1974 | Harris et al. | 5/296 |
| 3,993,002 | A | * | 11/1976 | Stroh | 108/108 |
| 4,109,797 | A | * | 8/1978 | Brunette | 211/133.5 |
| 4,122,955 | A | * | 10/1978 | Celms | 211/133.5 |
| 4,146,140 | A | * | 3/1979 | Suter et al. | 211/190 |
| 4,150,753 | A | * | 4/1979 | Stahl et al. | 211/105.1 |
| 4,189,123 | A | * | 2/1980 | Johnson | 248/222.51 |
| 4,205,815 | A | * | 6/1980 | Sauer et al. | 248/243 |
| 4,367,819 | A | | 1/1983 | Lewis | |
| 4,455,007 | A | * | 6/1984 | Varon et al. | 248/251 |
| 4,534,529 | A | * | 8/1985 | Dorner | 248/223.41 |
| 4,615,503 | A | * | 10/1986 | Garfinkle | 248/224.8 |
| 4,627,543 | A | | 12/1986 | Nicely | |
| 4,700,916 | A | * | 10/1987 | Bastian et al. | 248/224.8 |
| D311,858 | S | * | 11/1990 | Richmond | D8/373 |
| 5,080,238 | A | | 1/1992 | Hochman | |
| 5,116,007 | A | | 5/1992 | Von Gunton et al. | |
| 5,127,342 | A | | 7/1992 | Taylor | |
| 5,230,492 | A | * | 7/1993 | Zwart et al. | 248/220.42 |
| 5,265,740 | A | | 11/1993 | Hodsden et al. | |
| 5,415,302 | A | | 5/1995 | Carlson et al. | |
| 5,417,396 | A | * | 5/1995 | Merl | 248/222.14 |
| 5,423,251 | A | | 6/1995 | Kolvites et al. | |
| 5,443,167 | A | | 8/1995 | Menaged et al. | |
| 5,456,435 | A | * | 10/1995 | Sweeney | 248/250 |
| 5,477,971 | A | * | 12/1995 | Howard | 211/187 |
| 5,575,444 | A | * | 11/1996 | Otema | 248/242 |
| 5,921,190 | A | * | 7/1999 | Wood | 108/108 |
| 5,921,411 | A | * | 7/1999 | Merl | 211/90.01 |
| 6,017,009 | A | | 1/2000 | Swartz et al. | |
| 6,182,937 | B1 | | 2/2001 | Sanderse | |
| 6,431,090 | B1 | | 8/2002 | Davis et al. | |
| 6,481,678 | B1 | * | 11/2002 | Chong | 248/220.42 |
| 6,625,935 | B1 | * | 9/2003 | King et al. | 52/36.6 |
| 6,935,518 | B2 | | 8/2005 | Winig et al. | |
| 6,971,528 | B2 | | 12/2005 | Chen | |
| 7,040,494 | B2 | * | 5/2006 | Harper | 211/90.02 |
| 7,128,223 | B1 | * | 10/2006 | Sarnoff et al. | 211/90.03 |
| 7,284,671 | B1 | | 10/2007 | Doscher | |
| 7,387,213 | B1 | * | 6/2008 | Smalley | 211/106 |
| 7,404,533 | B1 | * | 7/2008 | Kologe | 248/220.22 |
| 7,494,019 | B2 | | 2/2009 | Kessell et al. | |
| 7,497,344 | B2 | * | 3/2009 | Chen | 211/187 |
| 7,654,497 | B1 | * | 2/2010 | Karan | 248/243 |
| 7,677,514 | B1 | * | 3/2010 | Palmer | 248/250 |
| 7,762,411 | B2 | * | 7/2010 | Hilburn et al. | 211/192 |
| 7,832,571 | B2 | | 11/2010 | Felsenthal | |
| 7,967,156 | B2 | | 6/2011 | Hsu | |
| 7,967,268 | B2 | | 6/2011 | Herron, III et al. | |
| 8,118,181 | B2 | | 2/2012 | Shinozaki | |
| 8,152,119 | B2 | * | 4/2012 | Pfund et al. | 248/220.43 |
| 8,235,339 | B2 | * | 8/2012 | Selvidge et al. | 248/220.21 |
| 8,468,844 | B2 | * | 6/2013 | Nagel et al. | 62/255 |
| 8,584,873 | B2 | * | 11/2013 | Horn et al. | 211/187 |
| 8,602,372 | B2 | * | 12/2013 | Yu et al. | 248/224.8 |
| 2002/0104938 | A1 | | 8/2002 | Simard | |
| 2005/0056604 | A1 | | 3/2005 | Chen | |
| 2005/0127017 | A1 | * | 6/2005 | Kessel et al. | 211/187 |
| 2005/0145147 | A1 | | 7/2005 | Costa et al. | |
| 2006/0091088 | A1 | | 5/2006 | McCoy | |
| 2007/0110511 | A1 | * | 5/2007 | Chen | 403/230 |
| 2008/0083685 | A1 | * | 4/2008 | Chen | 211/134 |
| 2008/0128373 | A1 | | 6/2008 | Chang et al. | |
| 2008/0142463 | A1 | | 6/2008 | Johnson | |
| 2008/0179267 | A1 | * | 7/2008 | Johnson | 211/87.01 |
| 2009/0014400 | A1 | | 1/2009 | Nawrocki | |
| 2010/0163504 | A1 | * | 7/2010 | Freeman | 211/103 |
| 2010/0200716 | A1 | * | 8/2010 | White, III | 248/243 |
| 2010/0327135 | A1 | * | 12/2010 | Selvidge et al. | 248/221.11 |
| 2011/0220602 | A1 | | 9/2011 | Chen | |
| 2012/0255924 | A1 | * | 10/2012 | Kologe | 211/126.15 |
| 2012/0292271 | A1 | | 11/2012 | Bevelacqua | |
| 2013/0020272 | A1 | | 1/2013 | Kropveld | |
| 2013/0020452 | A1 | * | 1/2013 | Yu et al. | 248/220.21 |

FOREIGN PATENT DOCUMENTS

| | | | | |
|---|---|---|---|---|
| FR | 1515478 | | 3/1968 | |
| GB | 002194134 | * | 3/1988 | |
| WO | WO 2005046401 A1 | * | 5/2005 | A47F 3/06 |

* cited by examiner

SUPPORT BRACKET

FIELD OF THE INVENTION

The present invention relates to support brackets, and more particularly to support brackets for shelving systems.

BACKGROUND

Strength and reliability are important issues relevant to shelving systems. In many conventional shelving system designs, a tradeoff exists between strength and reliability and other features, including manufacturability, material costs, and adjustability. Often times, individual shelves experience loading conditions that cause them to fail prematurely. Examples of failure include plastic (i.e., non-elastic) deformation due to bending or buckling, dynamic fracture, and fatigue-induced fracture. Cantilevered shelves are particularly susceptible to these types of failure when subjected to repeated impact loading, for example, when heavy loads are dropped onto the shelf from an appreciable height. Such failure leads to undesirable downtime, repair, or replacement, and the costs associated therewith.

SUMMARY

In one embodiment a shelving system includes a support post having a mounting surface and a plurality of vertically spaced retention members extending from the mounting surface. A shelf includes a bracket member configured for coupling to a first of the vertically spaced retention members. A support bracket includes an attachment portion configured for coupling to a second of the vertically spaced retention members adjacent the first vertically spaced retention member and a support portion configured for coupling to the bracket member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is adjacent the first retention member. The support bracket further includes a support portion extending from the attachment portion and formed to be disposed substantially about the support member.

In one embodiment a shelving system includes a support post having a mounting surface and a plurality of vertically spaced retention members extending from the mounting surface. A shelf includes a bracket member configured for coupling to a first of the vertically spaced retention members and a support member secured to the bracket member. A support bracket includes an attachment portion having an aperture therethrough formed to receive a second of the vertically spaced retention members, in which the second retention member is adjacent the first retention member. The support bracket further includes a support portion comprising a generally C-shaped region forming a recess. The C-shaped region is formed to be disposed substantially about and to couple to the support member.

In one embodiment of a support bracket for a shelving system having a support post with a plurality of retention members extending therefrom and a shelf having a bracket member configured for coupling to a first of the plurality of retention members, wherein the shelf further includes a support member secured to the bracket member, the support bracket includes an attachment portion configured for coupling to a second of the plurality of retention members, in which the second retention member is spaced from the first retention member along a length of the support post. The support bracket further includes a support portion extending from the attachment portion and configured for supporting the support member.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
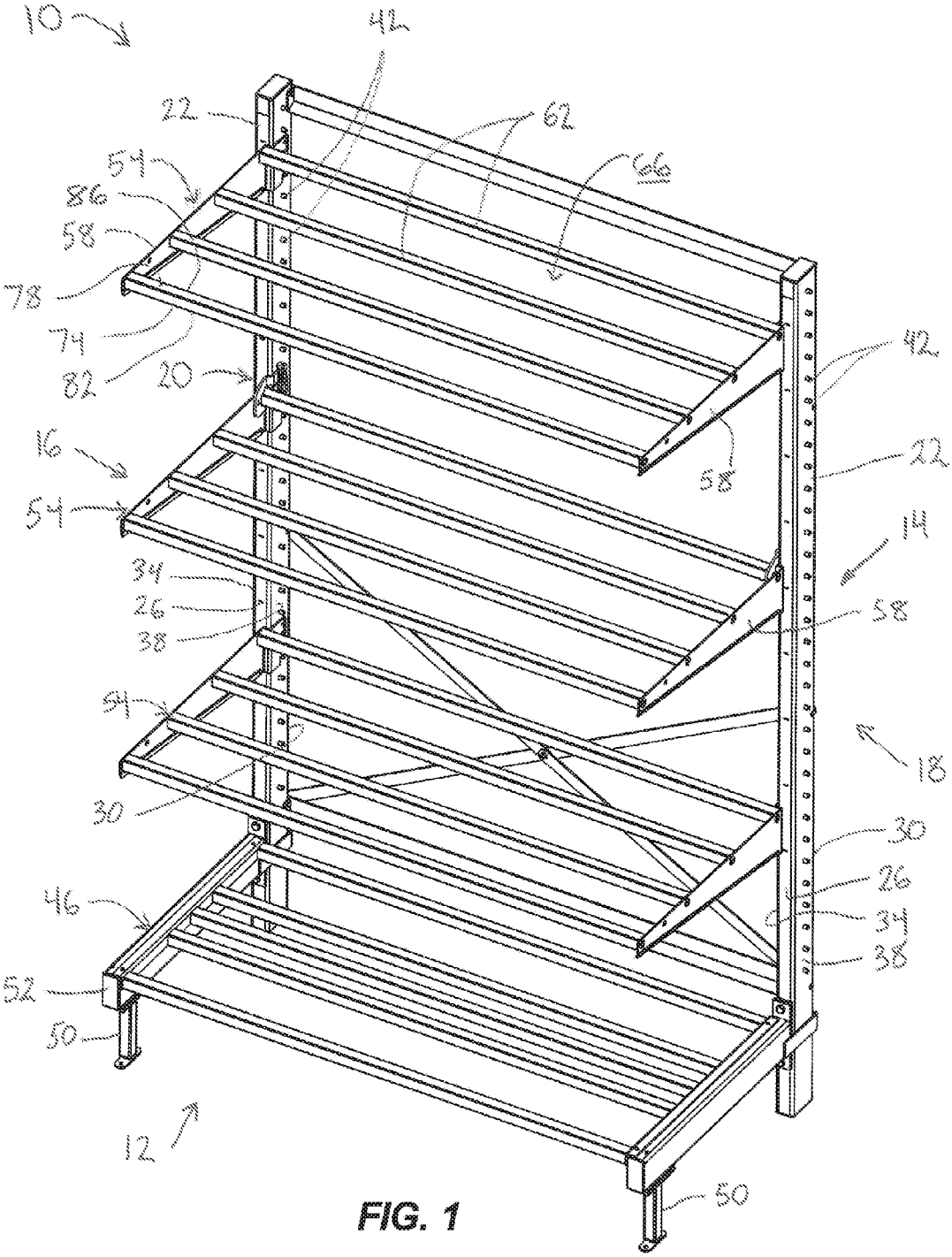
FIG. 1 is a perspective view of a shelving system including a support bracket.

FIG. 1 illustrates an exemplary shelving system 10 including one or more support brackets 20. The shelving system 10 is referenced herein with respect to a proximal end 12, a distal end 14, a left side 16, and a right side 18, the left and right sides 16, 18 referenced when viewed in the distal direction. The shelving system 10 includes a pair of vertical support posts 22 (i.e., left and right support posts 22) erected with respect to a ground or other support surface. Each post 22 defines a proximal side 26, a distal side 30, a left side 34, and a right side 38, and includes a plurality of vertically spaced retention members 42 in the form of support pins extending therethrough and protruding laterally from the left and right sides 34, 38. In the illustrated embodiment, the support pins 42 are spaced a distance of between about one inch and about four inches along the length of each post 22. In other embodiments, the support pins 42 can be spaced equally or unequally from each other. Each pin 42 is preferably press-fit in place but can be secured in any suitable manner generally known to those of skill in the art, e.g., welding, etc. In additional embodiments, the retention members can be in the form of hooks, ledges, or other shaped protrusions and forms affixed or otherwise coupled to each post 22.

A bottom shelf 46 nearest the ground or other support surface extends from the proximal side 26 of the posts 22 and includes a pair of support legs 50 at or near an end 52 that contacts the ground or other support surface to provide stability for the shelving system 10.

With continued reference to FIG. 1, the shelving system 10 includes one or more shelves 54 configured for coupling to the support posts 22. Each shelf 54 is mounted to the posts 22 by way of the support pins 42 and includes lateral brackets 58 with a plurality of support members 62 in the form of cross-braces extending therebetween to provide a generally planar support surface 66 for the shelf 54. Each of the support members 62 includes a proximal side 74 substantially perpendicular to the planar support surface 66, a top side 78 adjacent the planar support surface 66, a bottom side 82 opposite the top side 78, and a distal side 86 opposite the proximal side 74. As such, the illustrated support members 62 have a generally rectangular cross-section. However, other embodiments of a shelf 54 can include support members 62 having any other regularly or irregularly shaped cross-section, while still maintaining generally designated sides. For example, a support member having a circular cross-section (not shown) is oriented by definition to include top, bottom, front, and rear sides despite not having distinct surfaces separated by corners. In yet other embodiments, the lateral brackets 58 can be connected by a frame, sheet, series of bars or poles, mesh, screen, grate, or other form of support member extending between the lateral brackets 58 for purposes of supporting weight, through either direct contact or optionally through a separate supporting surface cover or platform upon which to store and/or display articles.

Figure 2:
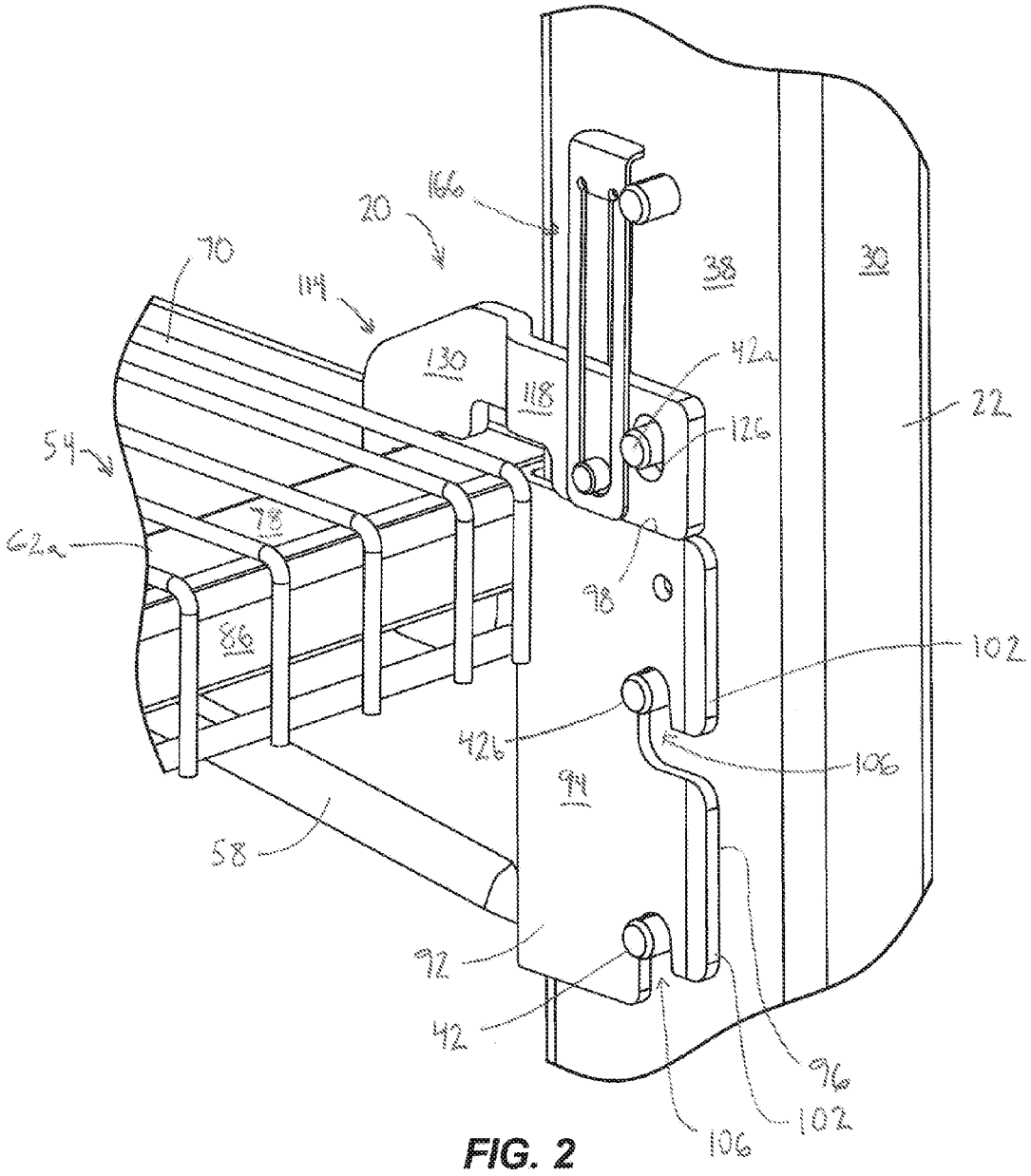
FIG. 2 is a partial perspective view of the shelving system showing the bracket identified in FIG. 1.
Figure 3:
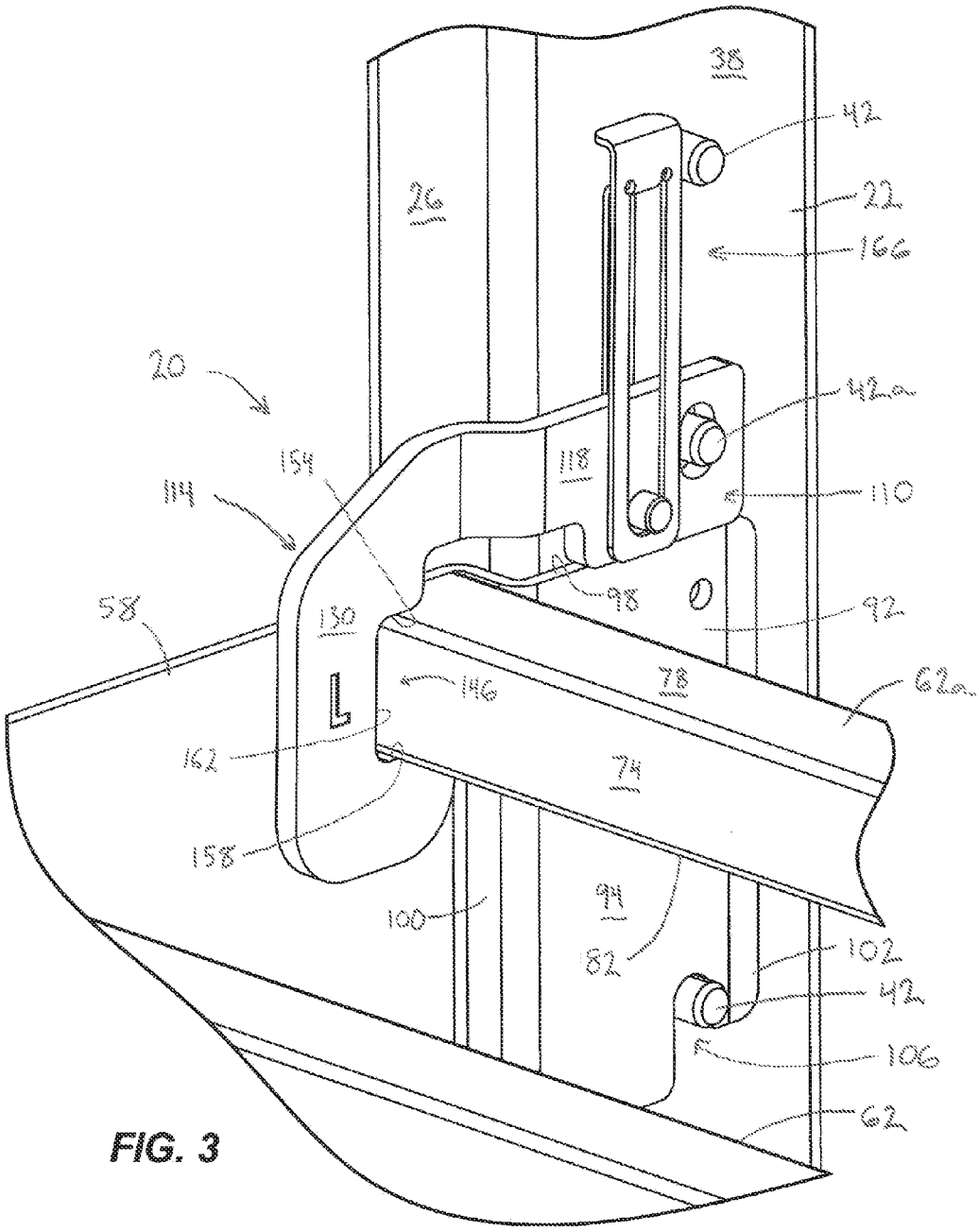
FIG. 3 is another partial perspective view of the shelving system showing the bracket identified in FIG. 1.

Referring to FIGS. 2 and 3, each of the lateral brackets 58 includes a flange member 92 having a first side 94 opposite the support post 22 when coupled thereto, a second side 96 adjacent the support post 22, and a top side 98 extending between the first side 94 and the second side 96. The flange member 92 also includes a bearing surface 100 adjacent and generally parallel to the proximal side 26 of the support post 22. Contact between the bearing surface 100 and the proximal side 26 prevents rotation of the shelf 54 on the post 22 due to the weight of the shelf 54 and additional loading placed upon the support members 62.

In the illustrated embodiment, the flange members 92 include a plurality of distally-extending fingers 102 or hooks that curve downward to form recesses 106. The recesses 106 each receive and removably secure a pin 42 to mount the shelf 54 to the post 22, preventing translational and rotational movement of the shelf due to loading forces. The fingers 102 or hooks can be equally or unequally spaced but are positioned to correspond to the support pins 42.

Figure 7:
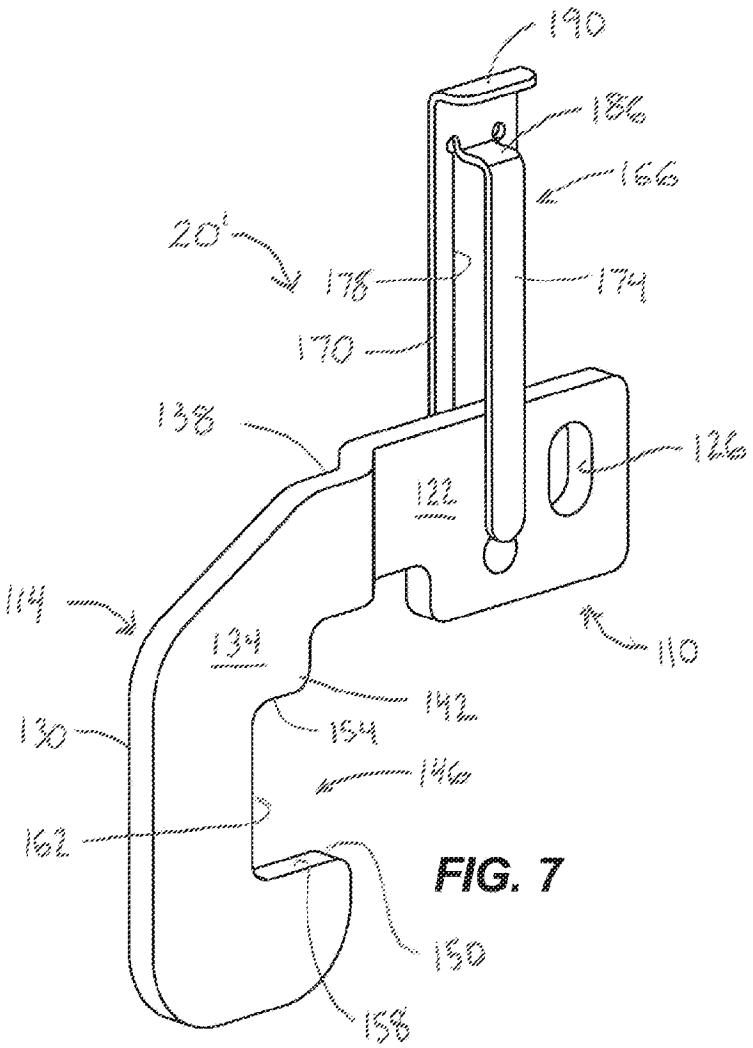
FIG. 7 is another perspective view of the support bracket of FIG. 6.

The support bracket 20, to be hereinafter described with reference to FIGS. 2-5, 8, and 9, is configured as a left-side bracket for coupling generally to the left side 16 of the shelving system 10. FIGS. 6 and 7 illustrate another support bracket 20' configured as a right-side support bracket for coupling generally to the right side of the shelving system 10. In other embodiments, the support brackets 20, 20' can be incorporated into the shelving system individually (e.g., for a shelving system having a single support post). The support bracket 20' of FIGS. 6 and 7 is a mirror image of the support bracket 20. As such, the support bracket 20' will not be described in detail herein, and like features of the support brackets 20 and 20' have been given like reference numerals. Although the support bracket 20 is described with respect to the shelving system 10 illustrated in FIG. 1, it should be understood that various embodiments of the support bracket 20 can be used with other types of shelving systems.

The support bracket 20 includes an attachment portion 110 and a support portion 114 continuously extending from the attachment portion 110. The attachment portion 110 includes a first side 118, a second side 122 opposite the first side 118, and an aperture 126 extending from the first side 118 to the second side 122. The aperture 126 is configured to receive a pin 42 projecting from the post 22 to couple the attachment portion 110 to the post 22. In other embodiments, the attachment portion 110 can be sized to include two or more apertures 126 to receive two or more pins 42 of the post 22. Alternative engagement features for coupling the attachment portion 110 with the post 22 or with posts of other shelving systems are within the scope of the present invention.

In the illustrated embodiment, the support bracket 20 is positioned on the post 22 with the second side 122 of the attachment portion 110 generally parallel and adjacent to the post 22, specifically the right side 38 of the post 22 (or the left side 34 for a support bracket 20'). The attachment portion 110 is positioned vertically adjacent the flange member 92 of a lateral bracket 58, and the aperture 126 of the attachment portion 110 receives the pin 42*a* adjacent the pin 42*b* engaged with the fingers 102 on the flange member 92, as illustrated in FIG. 2. As such, a portion of the support bracket 20 is positioned directly above the shelf 54. As shown in FIGS. 2 and 3, the attachment portion 110 abuts the top side 98 of the flange member 92, but in other embodiments, the attachment portion 110 can be spaced from the top side 98 of the flange member 92 and need not receive the pin adjacent the pin 42*b* (e.g., dependent on the spacing of the pins 42, the position of the aperture 126, or the shape of the attachment portion 110). In yet other embodiments, by varying the connection of the attachment portion 110 to the support portion 114, the support bracket 20 can be coupled to the post 22 such that the second side 122 of the attachment portion 110 is positioned laterally adjacent the flange member 92. In such an embodiment, the attachment portion 110 and the flange member 92 can be coupled to the same pin(s) 42.

Figure 5:
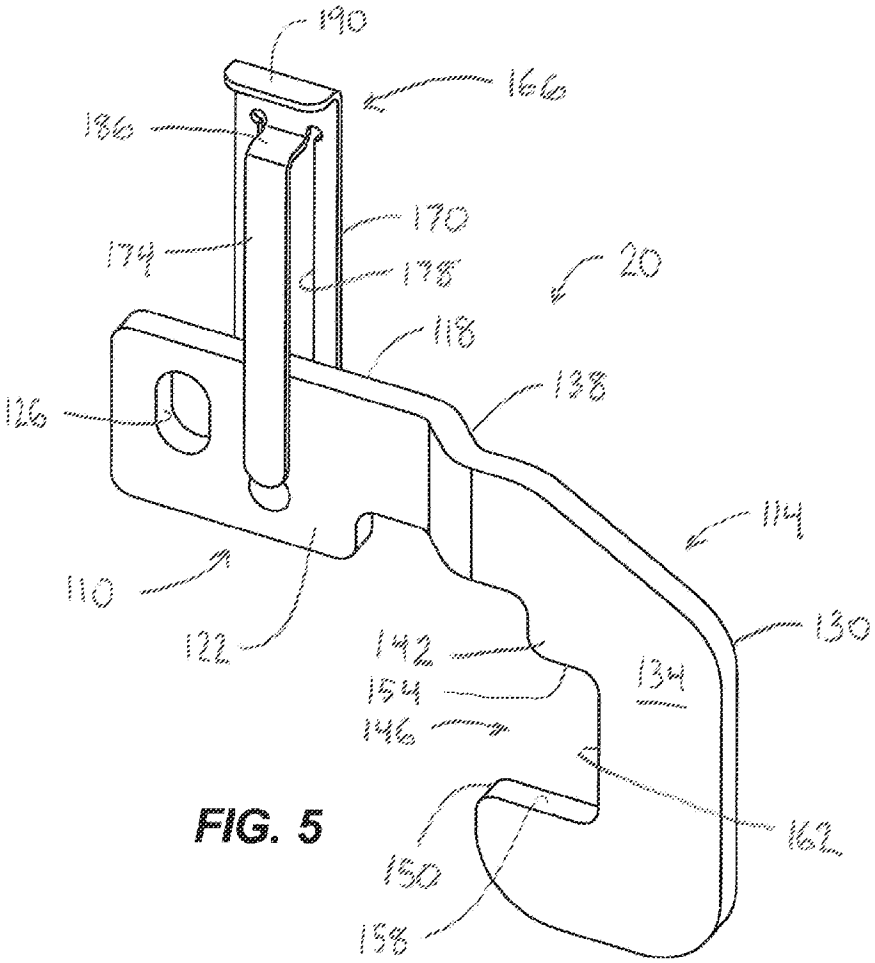
FIG. 5 is another perspective view of the support bracket of FIG. 2.
Figure 4:
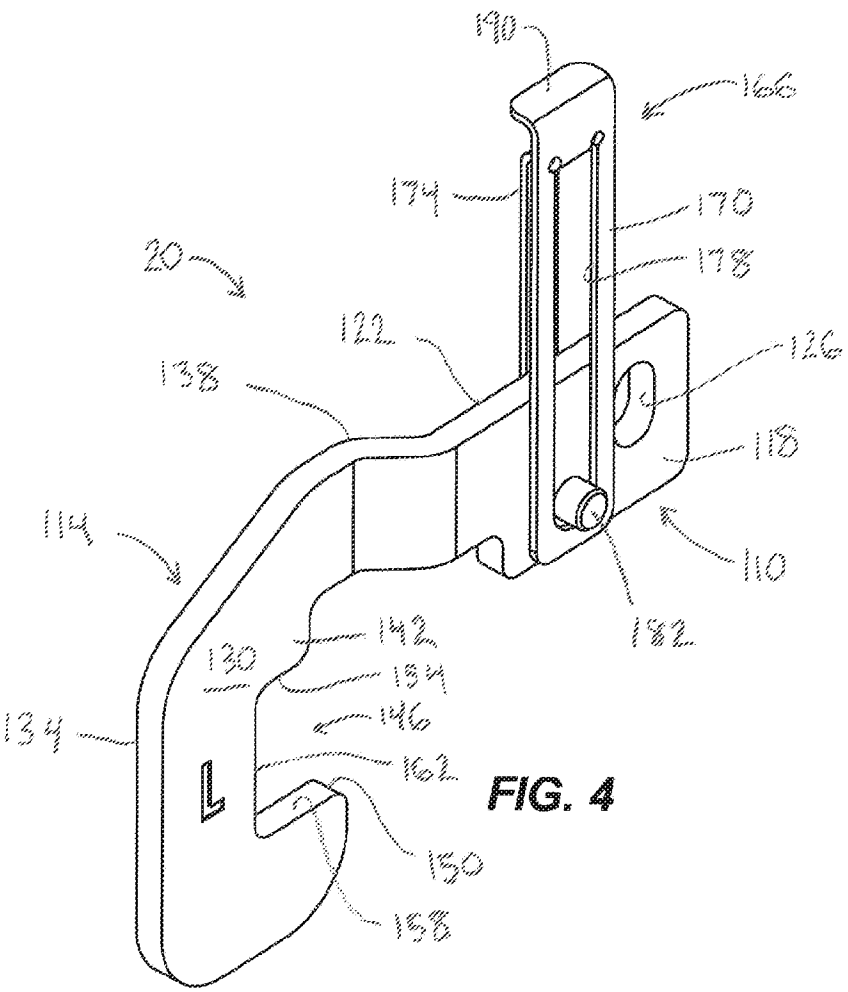
FIG. 4 is a perspective view of the support bracket of FIG. 2.
Figure 6:
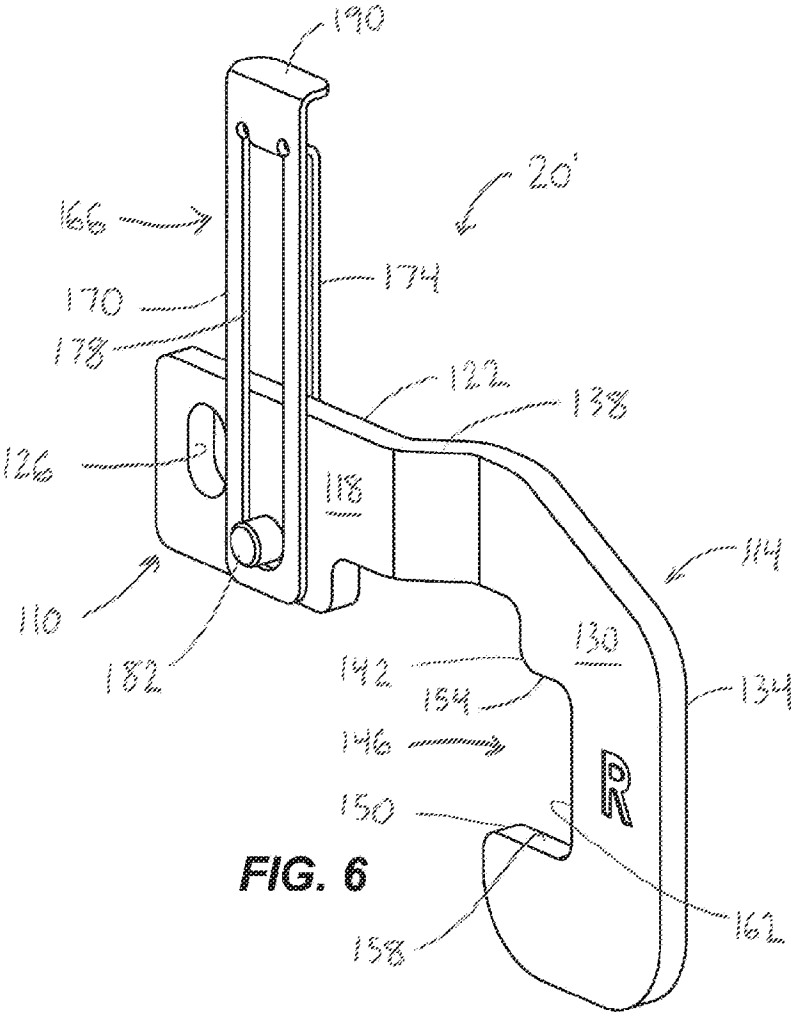
FIG. 6 is a perspective view of another support bracket for use with the shelving system of FIG. 1.
Figure 9:
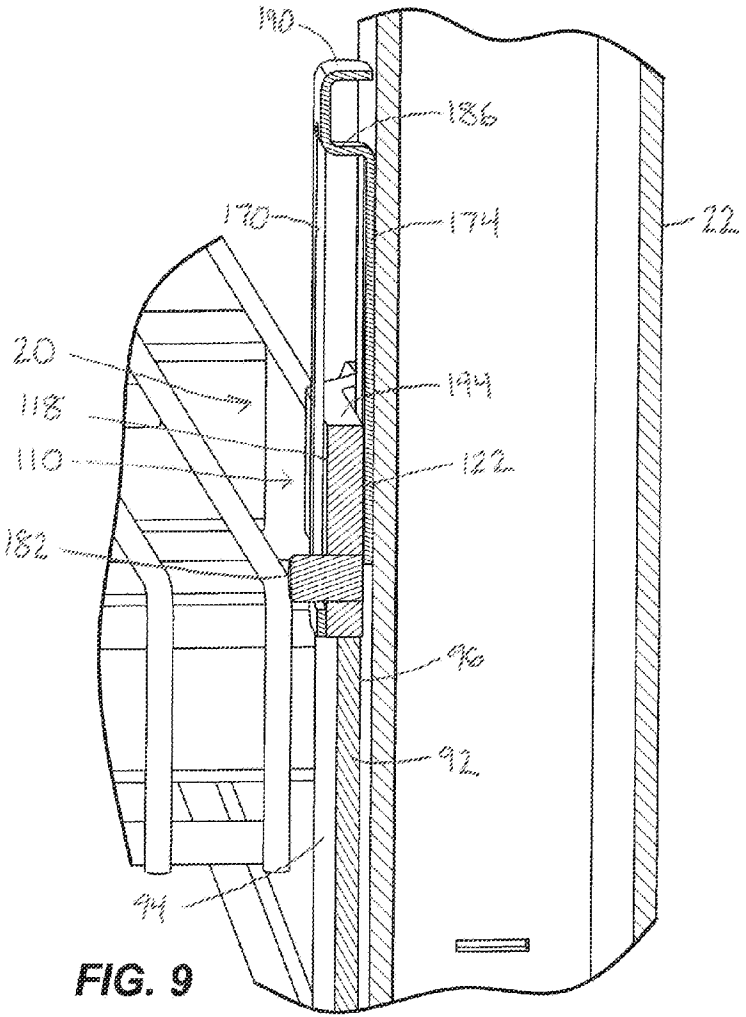
FIG. 9 is a cross-sectional view of a portion of the shelving system of FIG. 1, showing the lock member of the support bracket in an unlocked position.

Referring to FIGS. 4 and 5, the support portion 114 includes a first side 130 substantially parallel with the first side 118 of the attachment portion 110, and a second side 134 opposite the first side 130. A curved transition region 138 offsets the attachment portion 110 from the support portion 114. In other embodiments, the first and second sides 130, 134 of the support portion 114 can be generally coplanar with the first and second sides 118, 122 of the attachment portion 110. The support portion 114 further includes a generally C-shaped region 142 extending downward from the support portion (relative to the orientation of FIGS. 4 and 5). The C-shaped region 142 forms a recess 146 having an opening 150 oriented toward the attachment portion 110. The recess 146 is further defined by an upper wall 154, a lower wall 158, and an intermediate wall 162 extending between the upper wall 154 and the lower wall 158. The walls 154, 158, and 162 are configured to engage the distal support member 62*a* of the shelf 54 (when mounted to the post 22). Accordingly, in other embodiments, the recess 146 can have other shapes and/or orientations suitable to engage with the support member 62*a* or other shaped or sized member extending between lateral brackets 58 and supporting or otherwise forming the support surface cover or platform 66 upon which to store and/or display articles. For example, in some embodiments, the recess 146 can include a single curved wall to engage with a support member having a circular cross-section. In other embodiments with alternative mounting of the attachment portion 110, the C-shaped region 142 can extend upward from the support portion 114 to engage the support member 62*a*.

With reference to FIG. 3, the recess 146 of the support portion 114 is disposed about a portion of the distal support member 62*a* of the shelf 54 to engage and secure or otherwise support the support member 62*a* when the support bracket 20 is installed on the post 22. The upper wall 154 is positioned adjacent the top side 78 of the distal support member 62*a*, the intermediate wall 162 is positioned adjacent the proximal side 74 of the distal support member 62*a*, and the lower wall 158 is positioned adjacent the bottom side 82 of the distal support member 62*a*, i.e., the support portion 114 is disposed substantially about the support member 62*a*. At least one of the sides (e.g., the bottom side 82 and/or the proximal side 74) of the distal support member 62*a* contacts or bears against the adjacent wall (i.e., the lower 158 and/or intermediate wall 162) to transmit loading from the lateral bracket 58 through the distal support member 62*a* to the support bracket 20. The support bracket 20 then transmits this loading to the support post 22. Accordingly, the support bracket 20 reduces the stresses experienced by the lateral bracket 58 and strengthens the shelving system 10.

The support brackets 20, 20' are preferably formed from a single piece of metal, for example, by a stamping or cutting process.

Referring to FIGS. 4, 5, 8, and 9, the support bracket 20 includes a lock member 166 slidable relative to the support bracket 20 between an unlocked position (FIG. 9) in which the lock member 166 permits movement of the support bracket 20 relative to the flange member 92 and a locked position (FIG. 8) in which the lock member 166 inhibits movement of the support bracket 20 relative to the flange member 92. The lock member 166 includes a first leg 170 adjacent the first side 118 of the attachment portion 110 and a second leg 174 adjacent the second side 122 of the attachment portion 110. The first leg 170 includes a slot 178 extending therethrough, which receives a laterally extending projection 182 of the attachment portion 110 to couple the lock member 166 to the attachment portion 110. The slot 178 is slidable along the projection 182 as the lock member 166 moves between the locked position and the unlocked position. The lock member 166 also includes a connecting portion 186 extending between the first and second legs 170, 174, and an upper surface 190 extending generally perpendicular to the legs 170, 174 to facilitate positioning of the lock member 166. In the illustrated embodiment, the lock member 166 is integrally formed from a single piece of metal. For example, the second leg 174 can be stamped or cut from the first leg 170 to thereby define the slot 178, then bent to laterally offset the second leg 174 from the first leg 170, forming the connecting portion 186. In other embodiments, the lock member 166 can be formed from multiple pieces and/or through any suitable process.

Figure 8:
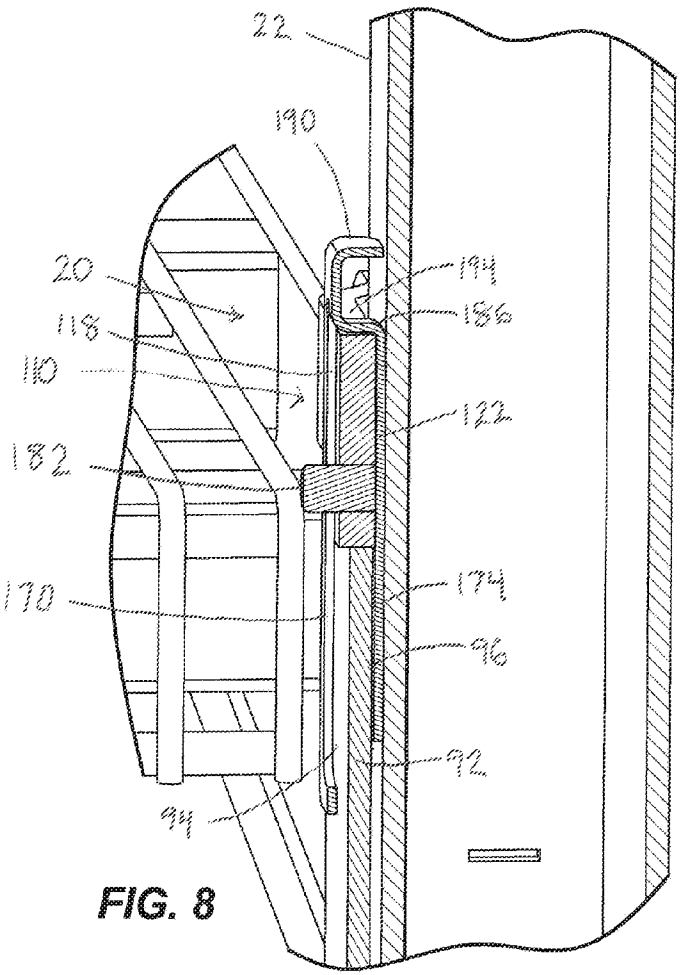
FIG. 8 is a cross-sectional view of a portion of the shelving system of FIG. 1, showing a lock member of the support bracket in a locked position.

With reference to FIG. 8, in the locked position, the connecting portion 186 of the lock member 166 abuts a top side 194 of the attachment portion 110 to provide an indication that the lock member 166 is fully engaged in the locked position. In the locked position of FIG. 8, the first leg 170 of the lock member 166 spans across both the first side 118 of the attachment portion 110 and the first side 94 of the flange member 92. Similarly, the second leg 174 of the lock member 166 spans across the second side of the attachment portion and the second side 96 of the flange member 92, disposed in the space defined between the surface 122 of bracket 20 and surface 96 of flange member 92, on the one hand, and the surface 38 of support post 22, on the other hand. As such, the attachment portion 110 and the flange member 92 are captured between the first and second legs 170, 174 of the lock member 166 and held in alignment. This prevents lateral movement of the support bracket 20 relative to the flange member 92 and keeps the bracket 20 in its optimal position for providing support to the shelf 54.

The support brackets 20 and 20' thereby assist in mitigating the mechanical stresses developed in the lateral brackets 58 due to shelf loading, such as impact loading, by providing a countering force to such loading. The support bracket can be readily installed without the need for any tools or external devices to new or existing shelving systems having a variety of different configurations, shelf depths, and lengths.

Various features of the invention are set forth in the following claims.

What is claimed is:

1. A shelving system comprising:

a support post having a mounting surface and a plurality of vertically spaced retention members extending from the mounting surface;

a shelf including a bracket member having a top surface and configured for coupling to a first of the vertically spaced retention members; and a support bracket including an attachment portion having a bottom surface and configured for coupling to a second of the vertically spaced retention members adjacent the first vertically spaced retention member, wherein when coupled to the second retention member the attachment portion extends above the bracket member and along the mounting surface toward the shelf and the bottom surface of the attachment portion abuts the top surface of the bracket member, and a support portion configured for coupling to the shelf.

2. The shelving system of claim 1, wherein the attachment portion includes an aperture therethrough formed to receive the second vertically spaced retention member.

3. The shelving system of claim 1, wherein the support bracket includes a lock member movable to a locked position in which the lock member inhibits movement of the support bracket relative to the shelf in at least one direction when the attachment member is coupled to the second retention member.

4. The shelving system of claim 3, wherein the at least one direction is a lateral direction with respect to the shelf.

5. The shelving system of claim 3, wherein the lock member includes a slot configured to slidably engage a projection extending from the attachment portion.

6. The shelving system of claim 1, wherein the shelf further includes a support member extending from the bracket member, the support member including a proximal side, a distal side opposite the proximal side, a top side extending between the proximal side and the distal side, and a bottom side opposite the top side.

7. The shelving system of claim 6, wherein the support portion of the support bracket is formed to engage the proximal side of the support member.

8. The shelving system of claim 6, wherein the support portion of the support bracket is formed to engage the proximal side and the bottom side of the support member.

9. The shelving system of claim 8, wherein the support portion is formed to extend about the top side and the proximal side of the support member.

10. The shelving system of claim 1, wherein the attachment portion and the support portion are stamped from a single piece of metal.

11. The shelving system of claim 1, wherein the support bracket is formed to couple to the second vertically spaced retention member and couple to the shelf without the use of an external tool.

12. The shelving system of claim 1, wherein each of the vertically spaced retention members is in the form of a pin.

13. A shelving system, comprising:

a support post having a mounting surface and a plurality of vertically spaced retention members extending from the mounting;

a shelf including a bracket member configured for coupling to a first of the vertically spaced retention members, and a support member secured to the bracket member; and a support bracket including an attachment portion having an aperture therethrough formed to receive a second of the vertically spaced retention members independently of the bracket member, the second retention member adjacent the first retention member, wherein when the attachment portion is coupled to the second retention member the attachment portion extends along the mounting surface toward the shelf, and a support portion comprising a generally C-shaped region forming a recess that opens toward the support post, wherein the C-shaped region is formed to be disposed substantially about and to support the support member.

14. The shelving system of claim 13, wherein each of the vertically spaced retention members is in the form of a pin.

15. A shelving system comprising:

a support post, the support post having a mounting surface and a second surface orthogonal to the mounting surface;

a shelf having a bracket member configured for coupling to the mounting surface, the shelf further including a support member secured to the bracket member; and a support bracket including an attachment portion defining a plane and configured for coupling independently of the bracket member to the mounting surface, and a support portion extending from the attachment portion and configured for supporting the support member, wherein the support portion is offset from the plane and when the support bracket is coupled to the mounting surface the support bracket is adjacent to both the mounting surface and the second surface of the post, and wherein the support portion forms a recess to be disposed substantially about the support member and to open toward the support post.

16. The shelving system of claim 15, wherein the support bracket includes a lock member movable to a locked position in which the lock member inhibits lateral movement of the support bracket relative to the bracket member when the attachment portion is coupled to the mounting surface.

17. The shelving system of claim 15, wherein the support portion comprises a generally C-shaped region.

18. The shelving system of claim 17, wherein the recess is further defined by an upper wall, a lower wall, and an intermediate wall extending between the upper wall and the lower wall, wherein at least one of the lower wall and the intermediate wall is configured to engage the support member.

* * * * *